US005104585A

United States Patent [19]

Fabry et al.

[11] Patent Number: 5,104,585

[45] Date of Patent: Apr. 14, 1992

[54] DETERGENT MIXTURE OF AN ALKYLGLYCOSIDE SURFACTANT AND AN HYDROXYALKYL SULFONATE

[75] Inventors: Bernd Fabry, Korschenbroich; Brigitte Giesen, Duesseldorf; Karlheinz Hill, Erkrath; Martina Kihn-Botulinski, Duesseldorf; Robert Piorr, Ratingen, all of Fed. Rep. of Germany

[73] Assignee: Henkel Kommanditgesellschaft aur Aktien, Dusseldorf, Fed. Rep. of Germany

[21] Appl. No.: 635,171

[22] PCT Filed: Jun. 29, 1989

[86] PCT No. PCT/EP89/00732
§ 371 Date: Mar. 7, 1991
§ 102(e) Date: Mar. 7, 1991

[87] PCT Pub. No.: WO90/00592
PCT Pub. Date: Jan. 25, 1990

[30] Foreign Application Priority Data

Jul. 7, 1988 [DE] Fed. Rep. of Germany ..... 3822997

[51] Int. Cl.[5] ..... C11D 1/12; C11D 1/83

[52] U.S. Cl. ..... 252/555; 252/549; 252/554; 252/174.17

[58] Field of Search ..... 252/549, 554, 555, 174.17

[56] References Cited

U.S. PATENT DOCUMENTS

| | | | |
|---|---|---|---|
| 4,536,318 | 8/1985 | Cook et al. | 252/174.17 |
| 4,565,647 | 1/1986 | Llenado | 252/174.17 |
| 4,663,069 | 5/1987 | Llendao | 252/174.17 |
| 4,732,696 | 3/1988 | Urfer | 252/174.17 |

FOREIGN PATENT DOCUMENTS

| | | |
|---|---|---|
| 0070074 | 1/1983 | European Pat. Off. . |
| 8602943 | 5/1986 | World Int. Prop. O. . |

*Primary Examiner*—Paul Lieberman
*Assistant Examiner*—Bradley A. Swope
*Attorney, Agent, or Firm*—Ernest G. Szoke; Wayne C. Jaeschke; Real J. Grandmaison

[57] ABSTRACT

The invention relates to a detergent mixture containing

A) at least one alkyl glycoside corresponding to general formula (I)

$$RO(G)_x \qquad (I)$$

in which

R is an aliphatic radical containing at least 8 carbon atoms, preferably a primary alcohol radical and, more preferably, a fatty alkyl or fatty alkenyl radical containing 8 to 22 and preferably 12 to 18 carbon atoms, G is a symbol which stands for a glycose unit, i.e. which derives from a reducing saccharide containing 5 or 6 carbon atoms and X is a number of 1 to 10, B) an anionic surfactant and C) typical auxiliaries and additives, characterized in that the anionic surfactant B) is at least one hydroxysulfonate consisting entirely or predominantly of compounds corresponding to formula (II) or (III)

$$CH_3(CH_2)_y\underset{\underset{OH}{|}}{CH}(CH_2)_p\underset{\underset{SO_3H}{|}}{CH}(CH_2)_z CH_2-O(C_nH_{2n}O)_xH \qquad (II)$$

$$CH_3(CH_2)_y\underset{\underset{SO_3H}{|}}{CH}(CH_2)_p\underset{\underset{OH}{|}}{CH}(CH_2)_z CH_2-O(C_nH_{2n}O)_xH \qquad (III)$$

in which y and z=0 or numbers of 1 to 18, p=0, 1 or 2 and the sum (y+z+p) is a number of 4 to 18, x=0 or a number of up to 30 and n may be an integer of 2 to 4, or alkali metal, alkaline earth metal and ammonium salts of such compounds, and to its use as a constituent of phosphate-reduced detergents and cleaning preparations.

9 Claims, No Drawings

DETERGENT MIXTURE OF AN ALKYLGLYCOSIDE SURFACTANT AND AN HYDROXYALKYL SULFONATE

This invention relates to detergent mixtures of nonionic surfactants, such as alkyl glycosides, and anionic surfactants, such as hydroxysulfonates, which are used as a constituent of phosphate-reduced detergents or cleaning preparations.

In the context of the invention, "phosphate-reduced" detergents are understood to be detergents which may contain at most 30% by weight alkali tripolyphosphates, but which may also be phosphate-free.

It is known from German patent application DE 19 61 855 that surfactant mixtures of two anionic surfactants, such as alkylbenzene sulfonates and alkyl ether sulfates or secondary linear alkane sulfonates and alkyl ether sulfates, show synergistic properties in regard to foaming and detergent effects.

EP 0 070 074 A2 describes a detergent mixture of alkyl glycosides and anionic surfactants.

EP 0 075 995 A2 describes a detergent mixture of alkyl glycosides and nonionic surfactants.

EP 0 105 556 A1 describes a liquid detergent mixture containing anionic surfactants, alkyl glycosides, selected nonionic surfactants and, optionally, other additives.

At present, most detergents are still produced from petrochemical raw materials. Economically the most important detergent and also the most widely used detergent in the western world belongs to the class of alkylbenzene sulfonate (ABS) surfactants (consumption in the USA and Western Europe in 1980: 790,000 t).

Although ABS shows good wetting and foaming power, its compatibility with the skin is limited which can lead to allergies. In addition, ABS is only partly biodegradable.

The problem addressed by the present invention was to provide a detergent mixture of a nonionic surfactant, such as an alkyl glycoside, and an anionic surfactant, such as a hydroxysulfonate, which consists entirely of native, i.e. renewable, oleochemical raw materials. This detergent mixture is intended to replace detergents, such as ABS, which are produced solely from petrochemical, i.e. non-renewable, raw materials, in phosphate-reduced detergents and cleaning preparations.

The present invention relates to a detergent mixture containing

A) at least one alkyl glycoside corresponding to general formula (I)

$$RO(G)_x \qquad (I)$$

in which

R is an aliphatic radical containing at least 8 carbon atoms, preferably a primary alcohol radical and, more preferably, a fatty alkyl or fatty alkenyl radical containing 8 to 22 and preferably 12 to 18 carbon atoms, G is a symbol which stands for a glycose unit, i.e. which derives from a reducing saccharide containing 5 or 6 carbon atoms and x is a number of 1 to 10, B) an anionic surfactant and C) typical auxiliaries and additives, characterized in that the anionic surfactant B) is at least one hydroxysulfonate consisting entirely or predominantly of compounds corresponding to formula (II) or (III)

$$CH_3(CH_2)_y\underset{\underset{OH}{|}}{CH}(CH_2)_p\underset{\underset{SO_3H}{|}}{CH}(CH_2)_zCH_2-O(C_nH_{2n}O)_xH \qquad (II)$$

$$CH_3(CH_2)_y\underset{\underset{SO_3H}{|}}{CH}(CH_2)_p\underset{\underset{OH}{|}}{CH}(CH_2)_zCH_2-O(C_nH_{2n}O)_xH \qquad (III)$$

in which y and z=0 or numbers of 1 to 18, p=0, 1 or 2 and the sum (y+z+p) is a number of 4 to 18, x=0 or a number of up to 30 and n may be an integer of 2 to 4, or alkali metal, alkaline earth metal and ammonium salts of such compounds.

The detergent mixtures according to the invention show significantly better biodegradability than ABS in the closed bottle test and distinctly better compatibility with the skin in the epidermis swelling test, as demonstrated in the Examples.

In addition, phosphate-reduced detergents containing the detergent mixture according to the invention show better detergent performance than commercially available phosphate-reduced detergents based on ABS.

The detergent mixtures according to the invention may be mixed in any ratio to one another, the mixing ratio of alkyl glycoside to hydroxysulfonate being from 10:90% to 90:10%.

The products according to the invention remain liquid up to a content of 75% washing-active substance (WAS) whereas products based on ABS form precipitates and are no longer pumpable beyond a WAS content of 60%.

Alkyl glycosides suitable for the purposes of the invention are described, for example, in U.S. Pat. Nos. 3,547,828 and 3,839,318. Particularly preferred alkyl glycosides are the products described in German patent application P 37 23 826.4 which have an alkyl monoglycoside content of more than 70% by weight (based on the total quantity of alkyl monoglycosides and alkyl oligoglycosides) and an average degree of oligomerization x of less than 1.5.

Typical alkyl glycosides are those in which alkyl stands for octyl, nonyl, decyl, undecyl, dodecyl, tridecyl, tetradecyl, pentadecyl, hexadecyl, heptadecyl, octadecyl and mixtures thereof. Particularly suitable alkyl glycosides contain a coconut oil fatty alkyl radical, i.e. dodecyl and tetradecyl radicals.

The sugar emanates from the usual aldoses and ketoses, such as for example glucose, fructose, mannose, galactose, talose, gulose, allose, altrose, idose, arabinose, xylose, lyxose and ribose. By virtue of the high reactivity and ready availability of glucose, alkyl glucosides are the particularly preferred alkyl glycosides. The index x may be a number of 1 to 10 and represents the so-called degree of oligomerization, i.e. the distribution of monoglycosides and oligoglycosides. Whereas, in a given compound, x must always be a whole number, above all the number 1, 2, 3 or 4, the value x for a special alkyl glycoside product is an analytically determined calculated value which is generally a broken number. Where the alkyl glycosides are represented by the formula $RO(G)_x$, the fatty alcohol component is disregarded. In principle, this fatty alcohol component may largely be controlled by careful treatment of the alkyl glycoside by distillation, i.e. the fatty alcohol excess emanating from the reaction can be removed from the product to residues of less than 1% of the total content.

The alkyl glycosides essentially containing $C_{12-22}$ alkyl or alkenyl radicals belong to the class of nonionic surfactants.

However, whereas only the hydrophobic component of typical nonionic surfactants of the alkyl polyglycol ether type emanates from renewable raw materials where it is being made up of ethylene oxide units and, hence, of a petrochemical raw material, the alkyl glycosides as fatty alkyl glycosides can be produced entirely from renewable raw materials, namely fats on the one hand and sugars or starches on the other hand.

Although alkyl glycosides of which the alkyl radical derives from synthetic primary alcohols, more particularly the so-called oxoalcohols, i.e. primary alkanols which contain a certain percentage, generally 20 to 40%, of branched isomers, mostly with a 2-methyl radical, may also be used for the purposes of the invention, surfactants such as these are less preferred when emphasis is placed on the intentional use of surfactants based on natural raw materials, including the hydrophobic component.

The hydroxysulfonates used as second component for the purposes of the invention are described in detail in earlier German patent application P 37 25 030.2. They are obtained, for example, by reaction of an unsaturated fatty alkyl ester or fatty alkyl polyoxyalkyl ester corresponding to general formula (IV)

$$R^1-O-(C_nH_{2n}O)_x-\overset{\overset{\displaystyle O}{\|}}{C}-R^2 \qquad \text{(IV)}$$

in which $R^1$ is a linear $C_{16-22}$ alkenyl group or a fatty alkyl group consisting predominantly of oleyl, palmitoleyl, linoleyl, gadoleyl and/or erucyl groups, n is an integer of 2 to 4, x=0 or a number of up to 30 and $R^2CO$ is a $C_{1-4}$ acyl group, with sulfur trioxide, introduction of the reaction product into an aqueous solution of 1 to 2.5 mol alkali, alkaline earth or ammonium hydroxide per mol $SO_3$ added and heating of the solution until the ester and sultone groups present have been hydrolyzed.

Preferred hydroxysulfonates as a component of the detergent mixture according to the invention are obtained when an unsaturated $C_{12-18}$ and preferably $C_{16-18}$ fatty alcohol or fatty alkyl polyoxyalkyl ester corresponding to formula (IV), in which n=2 and x=0 or a number of up to 20, preferably 1 to 10, i.e. an ester of an unsaturated fatty alcohol and an adduct of up to 20 mol ethylene oxide, preferably up to 10 mol ethylene oxide, with an unsaturated fatty alcohol, is used for the sulfonation reaction. The group $R^2$-CO may be a formyl, acetyl, propionyl or butyryl group; the acetyl group is preferred. The group $R^1$ is preferably an oleyl group or a fatty alkyl radical consisting predominantly of oleyl groups.

Accordingly, preferred values for the sum (y+z+p) in the compounds (II) and (III) are 12 to 18 and preferably 12 to 14.

Suitable auxiliaries and additives in the context of the invention are typical auxiliaries and additives, such as for example builders, bleaches, foam stabilizers, complexing agents, optical brighteners, thickening agents, soil suspending agents, redeposition inhibitors, dyes, perfume oils, enzymes, bactericides, fungicides, etc.

Other surfactants may also be added to the mixture providing they do not adversely affect the synergistic effect of the detergent mixture according to the invention.

The invention is illustrated by the following Examples and Application Examples.

APPLICATION EXAMPLE 1

Detergent power of mixtures of hydroxysulfonates (diol(ether)sulfonates and alkyl glucosides in a phosphate-free single formulation Substances used HOS = $C_{18}$ diol sulfonate Na salt based on Ocenol 90/95 (oleyl alcohol, technical)

HOES5 = $C_{18}$ diol ether sulfonate Na salt based on Ocenol 90/95 ethoxylated with on average 10 mol EO AG = $C_{12-14}$ glucoside (degree of oligomerizaiton 1.3)

Zeolite NaA = product used in the form of an undried, stabilized suspension still moist from its production; calculated as anhydrous substance in the formulations; calcium binding power 165 mg CaO/g, as determined in accordance with DE 24 12 837 A1.

Sokalan ®Cp5 = copolymer of acrylic acid and maleic acid

ABS = dodecylbenzene sulfonate Na salt

Formulations (% by weight)

| | | | | | |
|---|---|---|---|---|---|
| A) | 3.0 | waterglass | B) | 3.0 | waterglass |
| | 1.5 | coconut oil fatty acid, sodium salt | | 1.5 | coconut oil fatty acid, sodium salt |
| | 20.0 | zeolite NaA | | 20.0 | zeolite NaA |
| | 3.5 | Sokalan CP5 | | 3.5 | Sokalan CP5 |
| | 7.0 | soda | | 7.0 | soda |
| | 41.0 | sodium sulfate | | 41.0 | sodium sulfate |
| | 13.5 | ABS | | 7.5 | alkyl glucoside |
| | 1.5 | $C_{16-18}$ fatty alcohol ethoxylated with on average 8 mol EO | | 7.5 | HOS |
| C) | 3.0 | waterglass | D) | 3.0 | waterglass |
| | 1.5 | coconut oil fatty acid, sodium salt | | 1.5 | coconut oil fatty acid, sodium salt |
| | 20.0 | zeolite NaA | | 20.0 | zeolite NaA |
| | 3.5 | Sokalan CP5 | | 3.5 | Sokalan CP 5 |
| | 7.0 | soda | | 7.0 | soda |
| | 41.0 | sodium sulfate | | 41.0 | sodium sulfate |
| | 7.5 | alkyl glucoside | | 7.5 | alkyl glucoside |
| | 7.5 | HOES5 | | 7.5 | HOES10 |

| Formulation | Remiss. 1.[1] % | Remiss. 2.[2] % | Remiss. 3.[3] % |
|---|---|---|---|
| A (Comparison) | 44.5 | 33.5 | 43.5 |
| B | 55.0 | 33.0 | 47.0 |
| C | 57.5 | 35.0 | 48.5 |
| D | 56.0 | 36.0 | 49.0 |

Test soils:
[1]Grease/pigment soil
[2]Cosmetic soil
[3]Mineral oil

Washing conditions

Miele W760, 85 g/machine, 30° C., 1-wash program, colored washing, load containing 3.5 kg clean washing, 16° Gh, 3x determination.

Comparison of the ABS-based formulation according to the prior art (formulation A) with the formulations containing the detergent mixture according to the invention formulations B to D) shows distinctly improved detergent performance for the detergents according to the invention. This effect occurs unexpectedly above all in the case of grease/pigment soil and mineral oil. The remission values obtained for the detergent mixtures according to the invention in a phosphate-free formulation even exceed the remission values for a phosphate-containing formulation documented in Application Example 2.

APPLICATION EXAMPLE 2

Detergent performance of mixtures of hydroxysulfonates (diolsulfonates) and alkyl glucosides in a phosphate-containing single formulation The substances used had the chemical composition defined in Application Example 1.

Formulations (% by weight):

| | | | | | |
|---|---|---|---|---|---|
| A) | 5.0 | waterglass | B) | 5.0 | waterglass |
| | 2.0 | coconut oil fatty acid sodium salt | | 2.0 | coconut oil fatty acid sodium salt |
| | 20.0 | sodium tripolyphosphate | | 20.0 | sodium tripolyphosphate |
| | 13.5 | ABS | | 7.5 | alkyl glucoside |
| | 1.5 | $C_{16-18}$ fatty alcohol ethoxylated with on average 8 mol EO | | 7.5 | HOS |
| | | balance: sodium sulfate and water | | | balance: sodium sulfate and water |

| Formulation | Remiss. 1.[1] % | Remiss. 2.[2] % | Remiss. 3.[3] % |
|---|---|---|---|
| A (Comparison) | 52.3 | 32.5 | 45.1 |
| B | 54.7 | 33.0 | 39.7 |
| C | 59.0 | 34.0 | 48.0 |
| D | 58.4 | 35.0 | 48.3 |

(Surfactant component of formulations C and D as in Example 1, formulations otherwise as in B above).
Test soils:
[1]Grease/pigment soil
[2]Cosmetic soil
[3]Mineral oil Washing conditions Miele W760, 85 g/machine, 30° C., 1-wash program, colored washing, load containing 3.5 kg clean washing, 16° Gh, 3x determination.

Comparison of the ABS-based formulation according to the prior art (formulation A) with the formulation containing the detergent mixture according to the invention formulation B) shows a better detergent performance for the detergent mixture according to the invention.

APPLICATION EXAMPLE 3

Detergent performance of detergent mixtures of hydroxysulfonates (diol(ether)sulfonates) and alkyl glucosides and comparison with ABS The substances used have the chemical composition defined in Application Example 1.

| HOS % by weight | HOES5 % by weight | AG % by weight | ABS % by weight | Remiss.[1] % by weight | Remiss.[2] % by weight |
|---|---|---|---|---|---|
| | | | 100 | 34.0 | 41.6 |
| 100 | | 0 | | 31.9 | 41.7 |
| 90 | | 10 | | 32.8 | 40.8 |
| 75 | | 25 | | 33.7 | 39.2 |
| 50 | | 50 | | 33.0 | 36.5 |
| 25 | | 75 | | 31.4 | 32.2 |
| 10 | | 90 | | 28.3 | 28.6 |
| 0 | | 100 | | 25.7 | 26.7 |
| | 100 | 0 | | 31.9 | 41.7 |
| | 90 | 10 | | 33.1 | 41.2 |
| | 75 | 25 | | 35.4 | 42.3 |
| | 50 | 50 | | 35.9 | 41.6 |

-continued

| HOS % by weight | HOES5 % by weight | AG % by weight | ABS % by weight | Remiss.[1] % by weight | Remiss.[2] % by weight |
|---|---|---|---|---|---|
| | 25 | 75 | | 36.4 | 39.8 |
| | 10 | 90 | | 35.4 | 37.2 |
| | 0 | 100 | | 34.3 | 35.5 |

Formulation:
The remission measurements relate to the following builder-containing and builder-free formulatons:
[1]0.5 g AS/1 + 2.0 g sodium sulfate
[2]0.5 g AS/1 + 1.5 g NaTPP/zeolite NaA (1:1)

Washing conditions 16° Gh, liquid=1:30, 10 steel balls for weighting, 30 mins. washing, 4×30 secs. rinsing, H-SH-PBV fabric, 40° C.

Comparison of the detergent performance according to the prior art (ABS) with the detergent performance of the detergent mixtures according to the invention shows improved detergent performance, particularly in the case of alkoxylated hydroxysulfonates, in the presence or absence of a builder.

EXAMPLE 1

Biological degradability in the closed bottle test

The degradability of surfactants can be evaluated on the basis of the biochemical oxygen demand (BOD) during microbial oxidation. To this end, a ratio is established between the theoretical BSBT value (in %), which indicates the quantity of oxygen required for complete oxidation of the test substance to $CO_2$, $H_2O$, $SO_4^{2-}$, $NO_3^-$, etc., and the value actually observed (cf. "Tenside Detergents" 8, 4 (1971) 182).

The test was carried out over a period of 30 days in a closed system at a test concentration of 2 mg AS/l (for the test method, see "Fette Seifen Anstrichmittel" 65 (1963) 37).

If the BOD value of the ABS determined under these conditions is equated with 100%, the following results are obtained for the detergent mixtures claimed in accordance with the invention (substances as defined in Application Example 1):

ABS (Comparison) = 100%
HOS:AG = 90:10 = 160%
HOS:AG = 50:50 = 140%
HOS:AG = 10:90 = 122%
HOES5:AG = 90:10 = 155%
HOES5:AG = 50:50 = 138%
HOES5:AG = 10:90 = 122%
HOES10:AG = 90:10 = 153%
HOES10:AG = 50:50 = 137%
HOES10:AG = 10:90 = 122%

The Example shows that the detergent mixtures according to the invention are distinctly more readily biodegradable than ABS.

EXAMPLE 2

Skin compatability in the epidermis swelling test

In this skin compability test, hog epidermis is placed in an aqueous solution of the surfactant to be tested and the degree of swelling is compared with that obtained in pure water. A surfactant is more compatible with the skin, the lower the degree of swelling. Experience has shown the swelling factors observed in this method for anionic surfactants and systems containing anionic surfactants correlate very well with in vivo skin compatability measurements (cf. J. Soc. Cosmet. Chem. Jap. 20 (1986) 17).

If the degree of swelling produced by an aqueous 2% ABS solution is equated with 100%, the following results are obtained for the detergent mixtures according to the invention (substances as defined in Application Example 1):

| |
|---|
| ABS (Comparison) = 100% |
| HOS:AG = 90:10 = 11% |
| HOS:AG = 50:50 = 12% |
| HOS:AG = 10:90 = 18% |
| HOES5:AG = 90:10 = 10% |
| HOES5:AG = 50:50 = 14% |
| HOES5:AG = 10:90 = 18% |
| HOES10:AG = 90:10 = 6% |
| HOES10:AG = 50:50 = 12% |
| HOES10:AG = 10:90 = 18% |

It can be seen that the detergent mixtures according to the invention are distinctly more compatible with the skin than ABS.

We claim:

1. A detergent mixture containing

A) at least one alkyl glycoside corresponding to general formula (I)

$$RO(G)_x \quad (I)$$

in which

R is an aliphatic radical containing at least 8 carbon atoms, preferably a primary alcohol radical and, more preferably, a fatty alkyl or fatty alkenyl radical containing 8 to 22 and preferably 12 to 18 carbon atoms, G is a symbol which stands for a glucose unit, i.e. which derives from a reducing saccharide containing 5 or 6 carbon atoms and x is a number of 1 to 10, B) an anionic surfactant and C) typical auxiliaries and additives, characterized in that the anionic surfactant B) is at least one hydroxysulfonate consisting entirely or predominantly of compounds corresponding to formula (II) or (III)

$$CH_3\text{-}(CH_2)_y\underset{\underset{OH}{|}}{CH}\text{-}(CH_2)_p\underset{\underset{SO_3H}{|}}{CH}\text{-}(CH_2)_z CH_2\text{-}O\text{-}(C_nH_{2n}O)_x H \quad (II)$$

$$CH_3\text{-}(CH_2)_y\underset{\underset{SO_3H}{|}}{CH}\text{-}(CH_2)_p\underset{\underset{OH}{|}}{CH}\text{-}(CH_2)_z CH_2\text{-}O\text{-}(C_nH_{2n}O)_x H \quad (III)$$

in which y and z=0 or numbers of 1 to 18, p=0, 1 or 2 and the sum (y+z+p) is a number of 4 to 18, x=0 or a number of to 30 and n may be an of 2 to 4, or alkali metal, alkaline earth metal and ammonium salts of such compounds.

2. A detergent mixture comprising

A) at least one alkyl glycoside corresponding to formula (I)

$$RO(G)_x \quad (I)$$

in which

R represents an aliphatic radical containing at least 8 carbon atoms,

G represents a glycose unit, and x is a number of about 1 to about 10, and

B) an anionic surfactant selected from the group consisting of a hydroxysulfonate corresponding to formula (II) and formula (II)

$$CH_3\text{-}(CH_2)_y\underset{\underset{OH}{|}}{CH}\text{-}(CH_2)_p\underset{\underset{SO_3H}{|}}{CH}\text{-}(CH_2)_z CH_2\text{-}O\text{-}(C_nH_{2n}O)_x H \quad (II)$$

$$CH_3\text{-}(CH_2)_y\underset{\underset{SO_3H}{|}}{CH}\text{-}(CH_2)_p\underset{\underset{OH}{|}}{CH}\text{-}(CH_2)_z CH_2\text{-}O\text{-}(C_nH_{2n}O)_x H \quad (III)$$

in which y and z=0 or a number from 1 to 18, p=0, 1 or 2 and the sum (y+z+p) is a number from 4 to 18, x=0 or a number of up to 30 and n is an integer of 2 to 4, and alkali metal, alkaline earth metal and ammonium salts of said compounds.

3. A detergent mixture as in claim 2 wherein in said hydroxysulfonate corresponding to formulae (II) and (III), the sum (y+z+p) is a number from about 12 to about 18 and x and n are as defined therein.

4. A detergent mixture as in claim 2 wherein in said hydroxysulfonate corresponding to formulae (II) and (III), x=0 to 20 and the sum (y+z+p) and n are as defined therein.

5. A detergent mixture as in claim 2 wherein in said hydroxysulfonate corresponding to formulae (II) and (III), n is about 2 and the sum (y+z+p) and x are as defined therein.

6. A detergent mixture as in claim 2 wherein said hydroxysulfonate corresponding to formulae (II) and (III) has been produced from oleyl alcohol or from a fatty alkyl residue containing oleyl alcohol.

7. A detergent mixture as in claim 2 wherein in said hydroxysulfonate corresponding to formulae (II) and (III), the sum (y+z+p) is a number from about 12 to about 18, x=0 to about 20, and n=2.

8. A detergent mixture as in claim 2 wherein in said alkyl glycoside corresponding to formula (I), R represents a fatty alkyl or fatty alkenyl radical containing from 8 to 22 carbon atoms.

9. A detergent mixture as in claim 2 containing from 0 up to about 30% by weight of alkali polyphosphates, based on the weight of said detergent mixture.

* * * * *

UNITED STATES PATENT AND TRADEMARK OFFICE

CERTIFICATE OF CORRECTION

PATENT NO. : 5,104,585

DATED : April 14, 1992

INVENTOR(S) : Fabry et al.

It is certified that error appears in the above-identified patent and that said Letters Patent is hereby corrected as shown below:

In claim 1, column 7, line 57, after "number of" insert --up--.

In claim 1, column 7, line 57, after "an" insert --integer--.

In claim 2, column 8, line 16, "and formula (II)" should read --and formula (III)--.

Signed and Sealed this

Thirty-first Day of August, 1993

*Attest:*

*Attesting Officer*

Bruce Lehman

BRUCE LEHMAN

*Commissioner of Patents and Trademarks*